United States Patent [19]

Arendt et al.

[11] 4,160,706

[45] * Jul. 10, 1979

[54] COATED SILICON-IRON PRODUCT AND PROCESS THEREFOR USING MAGNESIUM FORMATE AND METABORATE

[75] Inventors: Ronald H. Arendt; Matthew J. Curran, both of Schenectady, N.Y.

[73] Assignee: General Electric Company, Schenectady, N.Y.

[ * ] Notice: The portion of the term of this patent subsequent to Jun. 27, 1995, has been disclaimed.

[21] Appl. No.: 899,488

[22] Filed: Apr. 24, 1978

[51] Int. Cl.[2] ..... C25D 5/50; H01F 1/04

[52] U.S. Cl. ..... 204/37 R; 204/40; 204/56 R; 148/31.5; 148/113

[58] Field of Search ..... 204/37 R, 40, 56 R; 427/127, 132; 428/469, 471; 148/12.1, 27, 31.5, 111, 112, 113, 122

[56] References Cited

U.S. PATENT DOCUMENTS

| | | | |
|---|---|---|---|
| 3,054,732 | 9/1962 | McQuade | 204/37 R |
| 3,222,228 | 12/1965 | Stanley | 148/31.5 |
| 3,676,227 | 7/1972 | Matsumoto | 148/111 |
| 3,905,842 | 9/1975 | Grenoble | 148/111 |
| 4,030,950 | 6/1977 | Shilling | 148/112 |
| 4,097,343 | 6/1978 | Arendt | 204/37 R |

*Primary Examiner*—John H. Mack
*Assistant Examiner*—William Leader
*Attorney, Agent, or Firm*—Richard G. Jackson; Joseph T. Cohen; Leo I. MaLossi

[57] ABSTRACT

A boron-containing electrical steel sheet is provided with an electrolytically-deposited boron-containing $Mg(OH)_2$ primary coating about 0.05 mil thick and a secondary coating of electrolytically-deposited $Mg(OH)_2$ about 0.15 mil thick. Magnesium formate is employed as the water-soluble magnesium salt in preparing the electrolytes.

8 Claims, 1 Drawing Figure

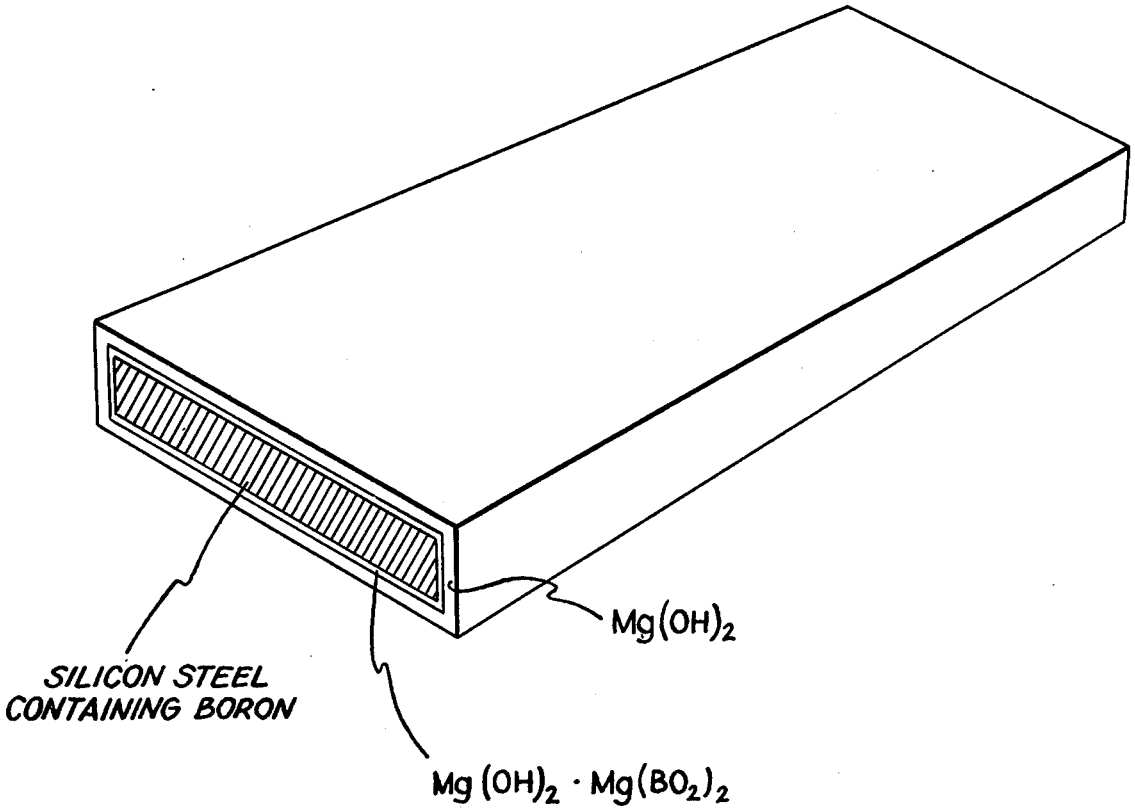
SILICON STEEL
CONTAINING BORON
$Mg(OH)_2$
$Mg(OH)_2 \cdot Mg(BO_2)_2$

COATED SILICON-IRON PRODUCT AND PROCESS THEREFOR USING MAGNESIUM FORMATE AND METABORATE

The present invention relates generally to the art of producing electrical steel and is more particularly concerned with a novel method of electrolytically depositing on a boron-containing silicon-iron magnetic sheet a coating of boron-containing electrically-insulating material in which the boron is concentrated in close proximity to the metal surface. This invention is also particularly concerned with the new and useful product of that process.

CROSS REFERENCES

Reference is made to copending U.S. patent application of Ronald H. Arendt and Patrick F. Aubourg, Ser. No. 774,808 (now U.S. Pat. No. 4,116,730), filed Mar. 7, 1977, entitled "Silicon-Iron Production and Composition and Process Therefor." That application is directed to a method of producing grain-oriented silicon-iron sheet wherein a boron-containing electrically-insulating coating is deposited on a boron-containing silicon-iron magnetic sheet from an aqueous solution including magnesia, magnesium metaborate and magnesium acetate. Reference is also made to our copending U.S. patent application Ser. No. 774,807 (now U.S. Pat. No. 4,097,343—issued June 27, 1978), filed Mar. 7, 1977, entitled "Coated Silicon-Iron Product and Process Therefor," and directed to the novel concept of providing a "duplex" refractory electrically-insulating coating of a primary layer of an electrolytically-deposited layer of a boron-containing magnesia. Reference is also made to our copending U.S. patent application Ser. No. 774,806, (now U.S. Pat. No. 4,096,001—issued June 20, 1978) filed Mar. 7, 1977, entitled, "Coated Silicon-Iron Product and Process Therefor" and directed to the novel concept of providing a calcium metaborate coating on silicon-iron sheet or strip material by an electrolytic deposition process. The foregoing applications are assigned to the assignee hereof and incorporated herein by reference.

BACKGROUND OF THE INVENTION

Following the discovery by Grenoble (U.S. Pat. No. 3,905,842 granted Sept. 16, 1975, and assigned to the assignee hereof) that boron is effective in small but critical amount and in critical proportion to nitrogen in silicon-iron to promote secondary recrystallization during the final texture-developing anneal, Maucione (U.S. patent application Ser. No. 677,147, filed Apr. 15, 1976, and also assigned to the assignee hereof) found that the presence of a very small amount of boron in the coating on such a boron-containing steel further promotes secondary recrystallization and development of still better magnetic properties in the ultimate product. Maucione further found that the presence of boron in the coating can cause secondary recrystallization to take place when it otherwise would not, and also discovered that the presence of boron in the insulating coating was not effective in causing or promoting secondary recrystallization in the absence of boron in the metal itself at the outset of the final anneal.

In the practice of Maucione's teachings, boron has been incorporated in the refractory oxide coating, usually magnesium hydroxide [$Mg(OH)_2$], provided in accordance with the process disclosed and claimed by McQuade in U.S. Pat. No. 3,054,732 by a dipping operation or by brushing a solution of a suitable boron compound on the coating, or even spraying it on.

Then, through the discovery by Arendt and Aubourg that a boron-containing compound and $Mg(OH)_2$ can be electrolytically codeposited as described and claimed in their patent application referred to above, it became possible to exercise better control over the amount of boron incorporated in the insulating coating and also to distribute the boron more uniformly throughout the coating. As another important advantage of this codeposition method, the resulting product has a surface which is more amenable to fabrication operations customarily involved in the use of electrical steel.

SUMMARY OF THE INVENTION

In accordance with our discoveries to be described, it is possible to enhance substantially the beneficial effect on the ultimate sheet product of boron in the coating without losing the foregoing advantages of the Maucione and the Arendt and Aubourg inventions. In particular, we have found how to achieve at once the heretofore conflicting objectives of using coating boron to prevent premature egress of boron from the silicon-iron sheet during the final anneal while limiting the boron content of the coating to a somewhat lower level to avoid detrimental effects of boron on the ultimate product. Specifically, we have discovered that the boron necessary to block loss of boron from the metal substrate too early in the final anneal can be provided in the form of a relatively thin primary coating. Further, we have discovered that by providing a somewhat heavier or thicker overcoat containing little or no boron, the boron of the primary coating will be retained in place in proximity to the metal surface long enough to insure development of the desired secondary recrystallization texture in the silicon-iron sheet. Consequently, both the boron concentration requirement and the total coating boron content requirement are met through these discoveries and the invention based thereon.

We have further found that while the overall thickness of the duplex or combination coating of this invention is not sharply critical to the attainment of our new results, it is important that the boron-containing primary coating be of thickness sufficient to provide the requisite amount of boron for the egress-blocking purpose. Consequently, the thinner the primary coating, the better in general and, in any event, it should not exceed about 0.07 mil in thickness because of the very limited mobility of boron at the relatively low temperatures prevailing during the critical early stage of the final anneal.

Additionally, we have found that while it is possible to provide the secondary coating other than by the electrolytic method, it is not feasible in production operations as a practical matter for the reasons indicated above concerning subsequent fabrication operations. Still further, we have found that while $Mg(OH)_2$ is preferred for this purpose, other refractory oxides may be used instead, as set forth in U.S. Pat. No. 3,054,732—McQuade.

Surprisingly and advantageously, we have now found that, by the practice of this invention, replacement of magnesium acetate in whole or in part with magnesium formate in the method described in our above-referenced patent application Ser. No. 774,807 (now U.S. Pat. No. 4,097,343) will significantly decrease the extent of carburization of the coated silicon-iron body which is effected during the approximately final or texture-developing anneal. Maximum such decrease is effected at total replacement with magnesium formate whereupon the extent of carburization (i.e., the percent increase in carbide content) will generally be not more than 40 percent (and typically not more than 20 percent) of the extent of carburization which would be observed under the same conditions except employing an amount of magnesium acetate which is equimolar with respect to the amount of magnesium formate employed. Notwithstanding that formate and acetate groups are homologs in the series of acylate groups, this discovered advantage of decreased carburization extent could not have been predicted since, as will be apparent to those skilled in the art, the formate group is the lowest member of the acylate series and the chemical behavior of such lowest members can not be reliably predicted from the chemical behavior of higher members in homolog series with respect to complex chemical phenomena, e.g., carburization.

Unexpectedly, it has now further been found by practice of this invention that use of magnesium formate results in codeposition of magnesium hydroxide and boron-containing compound to form a coating which is both at least as uniform and at least as strongly adherent to the silicon-iron substrate as the corresponding coating obtained using magnesium acetate. Comparison of the $K_a$ of about $1.8\times10^{-4}$ for formic acid with the $K_a$ of about $1.8\times10^{-5}$ for acetic acid would lead one of ordinary skill in the art to anticipate that, if a codeposited coating could be made from the ten-fold more acidic formate, such coating would be poorly adherent and of non-uniform character, e.g., an outwardly concave lenticular coating.

Briefly described, the new method of this invention comprises the steps of (a) providing a boron-containing electrical steel, (b) electrolyzing a solid MgO-buffered aqueous solution of magnesium formate and magnesium metaborate with the silicon-iron sheet material being arranged as the cathode in the solution and with the solution being at a temperature of at least about 65° C. and thereby covering the sheet with a boron-containing adherent electrically-insulating but relatively thin primary coating, of $Mg(OH)_2$ (c) electrolyzing a solid MgO-buffered aqueous solution consisting essentially of magnesium formate with the resulting coated sheet as the cathode in the magnesium formate solution and thereby covering the boron-containing $Mg(OH)_2$ coating with a substantially thicker secondary coating of $Mg(OH)_2$, and thereafter (d) subjecting the resulting double-coated sheet to a final heat treatment to develop (110)[001] secondary recrystallization texture in the silicon-iron sheet.

Similarly described, the article of this invention is the double-coated primary recrystallized product of this process including a primary boron-containing coating 0.02 to 0.07 mil thick and a secondary substantially boron-free coating about 0.10 to 0.18 mil thick.

DETAILED DESCRIPTION OF THE INVENTION

As illustrated by the drawing accompanying and forming a part of this specification, this invention is carried out using a boron-containing electrical steel sheet substrate and applying thereto a comparatively thin primary coating of suitable refractory material having electrically-insulating characteristics and containing magnesium metaborate substantially uniformly distributed throughout the coating. Then a substantially thicker coating of suitable refractory material is applied to the coated electrical steel sheet. As the initial step in the process, the substrate metal sheet is provided by preparing a silicon-iron melt of the required chemistry and then casting and hot rolling to intermediate thickness. Thus, the melt on pouring will contain from 2.2 to 4.5 percent silicon, manganese and sulfur in amounts in a ratio of manganese to sulfur less than 2.3, from about three to 50 parts per million boron and about 15 to 95 ppm nitrogen in the ratio range to boron of one and 15 parts to one, the remainder being iron and small amounts of incidental impurities including carbon, aluminum, copper and oxygen. Following anneal, the hot band is cold rolled with or without intermediate anneal to final gauge thickness and then decarburized.

The resulting fine-grained, primary recrystallized, silicon-iron sheet material in whatever manner produced is processed to provide the essential boron-containing primary coating and the secondary coating of this invention in preparation for the final texture-developing anneal. Processing at this point involves electrolytically codepositing $Mg(OH)_2$ and a boron compound source as disclosed and claimed in referenced patent application Ser. No. 774,808 except employing magnesium formate as the water soluble magnesium salt. With the sheet material connected as a cathode and the circuit as described in referenced U.S. Pat. No. 3,054,732 and immersed in an electrolyte as described above, a uniform thickness coating (suitably about 0.02 to 0.07 and preferably about 0.05 mil) of $Mg(OH)_2.XMg(BO_2)_2.YH_2O$, $X=\leqq1$, $Y=0-15$, is formed over that part of the sheet surface in contact with the electrolyte.

The electrolyte or electrolytic solution employed in step (b) of this method is preferably prepared by adding boric acid to an aqueous magnesium formate solution containing magnesia as a dispersed solid second phase. This magnesium formate solution is suitably of 0.05 to 1.0 molar concentration and preferably about 0.2 molar strength. The pH of the electrolyte so produced will be between 8.0 and 9.0, reflecting the presence of excess magnesia. The amount of boric acid added is that which will provide the requisite boron content of the ultimate coating, which is preferably between 10 and 70 parts per million on the basis of the silicon-iron substrate, as disclosed and claimed in copending U.S. patent application Ser. No. 677,146, filed Apr. 15, 1976, and assigned to the assignee hereof. At the outset of the electrolytic codeposition step, the electrolyte is at a temperature above about 65° C., preferably about 90°-95° C., and throughout the period that codeposition is conducted the electrolyte is maintained at such elevated temperature.

As the next step of this inventive method, the resulting coated sheet material is immersed in a solid MgO-buffered aqueous magnesium formate solution as a cathode and an electric current is applied across the terminals to provide an electrolytic deposit of $Mg(OH)_2$ over the boron-containing primary coating. This step is suitably carried out as disclosed and claimed in U.S. Pat. No. 3,054,732 so that the thickness of the duplex coating is in the range stated above. Additionally, in the preferred practice of this invention the secondary coating will contained little or no boron, it being a purpose of this invention to confine the boron to the primary coating so that it is present for its essential boron egress-blocking function and is not present in excess of that amount, particularly in the secondary coating. Such excess boron at locations relatively removed from the sheet material surface will become comparatively mobile at the temperatures prevailing in the latter stages of the usual final or texture developing anneal.

As the final step of the process of this invention, the resulting duplex or combination coated sheet is heated in hydrogen or a mixture of nitrogen and hydrogen to cause secondary grain growth which begins at about 950° C. As the temperature is raised at about 50° C. per hour to 1000° C., the recrystallization process is completed and heating may be carried on to up to 1175° C. if desired to insure complete removal of residual carbon, sulfur and nitrogen.

The following illustrative, but not limiting, examples of our novel process as actually carried out with the new results indicated above will further inform those skilled in the art of the nature and special utility of this invention.

EXAMPLE I

Eleven-mil strips of silicon-iron of the following composition were prepared as described in U.S. Pat. No. 3,905,842, (Grenoble) referred to above:

Carbon—0.030%
Manganese—0.035%
Sulfur—0.031%
Boron—0.0010%
Nitrogen—0.0050%
Copper—0.24%
Aluminum—0.005%
Iron—Remainder From this melt composition, 10.2 mil sheets were produced in a series of hot rolling passes followed by pickling and annealing of the intermediate thickness sheet material (about 100 mils) and cold rolling to 60 mils thickness, whereupon the material was reheated and cold rolled again to final thickness and the cold-worked sheet was given a decarburizing heat treatment at 800° C. for eight minutes in hydrogen (room temperature dew point).

Epstein strips were cut from the strip to provide four packs for ultimate magnetic properties test in the usual way. The strips comprising one such pack were electrolytically coated with $Mg(OH)_2$ through the use of a magnesium electrolyte as described in U.S. Pat. No. 3,054,732 (except that the magnesium salt employed in preparing the electrolyte was magnesium formate), the strips being cathodes in electric circuits and eight volts being applied across the terminals at a current density of 90 amperes per square foot until the coating mass on each strip was about 83.00 milligrams, (mg) i.e., about 0.0285 ounce per square foot, which is equivalent to about 0.22 mil average thickness over the entire surface area of the strip. Franklin insulation values for these strips as well as those of the other four packs of this experiment prepared as described below (allowance being made for minor thickness variations) were uniformly about 0.2 ampere following annealing in hydrogen at about 1175° C. for eight hours.

The strips of the three other packs were likewise electrolytically coated except that in each instance two separate coatings were provided, the first being a $Mg(BO_2)_2$ coating and the second being a $Mg(OH)_2$ coating like that of the first pack described just above. The electrolyte used for deposition of the primary coat was prepared by adding boric acid to a slurry of magnesium formate and magnesia in distilled water. The amount of boric acid added to the slurry was 0.4317 mole per liter calculated as set forth in referenced copending patent application Ser. No. 774,808.

As shown in Table I, the thickness of the primary and secondary coatings of the strips of the three duplex-coated Epstein packs were varied in this experiment to determine the effects of relative thickness upon magnetic properties of the finished electrical steel product, total coating thickness being maintained reasonably constant through the individual strips of all four packs. Also, as indicated in Table I, the first coating mass value refers in each instance to the primary $Mg(BO_2)_2$ coating, while the second designates the mass (i.e., relative thickness) of the secondary coating.

TABLE I

| | Loss, Watts Per Pound | | | Coating Masses |
|---|---|---|---|---|
| Pack | 15 kG | 17 kG | μ10 Oe | Mg Per Strip |
| 1 | 0.556 | 0.930 | 1755 | 0.00<br>83.00 |
| 2 | 0.498 | 0.689 | 1888 | 20.57<br>74.59 |
| 3 | 0.492 | 0.694 | 1893 | 16.03<br>70.20 |
| 4 | 0.500 | 0.707 | 1872 | 37.04<br>49.15 |

Note: All values are approximate

The ratio of MgO to $B_2O_3$ was made from 2.5 to 3.0 in the primary coatings on the strips of Pack 2, but only 1.5 to 2.0 in the corresponding borate coatings of Packs 3 and 4.

EXAMPLE II

In another experimental test of this invention process 10.0 mil Epstein strips like those of Example I (i.e., of the same composition and processing history) were coated by the procedures described just above with the results set out in Tables II and III:

TABLE II

| | Loss, Watts/Pound | | | 2.5 MgO $B_2O_3$ | $Mg(OH)_2$ |
|---|---|---|---|---|---|
| Pack | 15 kG | 17 kG | μ10 Oe | Mg/Strip | Mg/Strip |
| 1 | 0.476 | 0.677 | 1897 | 7.20 | 77.00 |
| 2 | 0.475 | 0.675 | 1888 | 13.90 | 69.10 |
| 3 | 0.483 | 0.674 | 1895 | 16.20 | 64.40 |
| 4 | 0.498 | 0.689 | 1888 | 20.57 | 74.59 |
| 5 | 0.468 | 0.656 | 1894 | 21.90 | 63.20 |
| 6 | 0.464 | 0.661 | 1887 | 23.70 | 63.70 |

Note: All values are approximate

TABLE III

| | Loss, Watts/Pound | | | 1.5 MgO $B_2O_3$ | $Mg(OH)_2$ |
|---|---|---|---|---|---|
| Pack | 15 kG | 17 kG | μ10 Oe | (mg/strip) | (mg/strip) |
| 3 | 0.467 | 0.655 | 1904 | 12.70 | 62.30 |
| 4 | 0.467 | 0.664 | 1891 | 15.10 | 62.80 |
| 5 | 0.492 | 0.694 | 1893 | 16.03 | 70.20 |
| 6 | 0.462 | 0.649 | 1906 | 19.90 | 66.60 |

Note: All values are approximate

Those skilled in the art will recognize that coating weight or thickness is commonly expressed in terms of density in ounces per square foot of steel strip surface and that 0.0275 oz/ft$^2$≡77 milligrams per Epstein strip. Further, it is understood generally that 77 mg/Epstein strip corresponds to a uniform coating thickness of 0.05 mil.

What we claim as new and desire to secure by Letters Patent of the United States is:

1. The method of producing grain-oriented silicon-iron sheet which comprises the steps of (a) providing a fine-grained primary-recrystallized silicon-iron sheet containing 2.2 to 4.5 percent silicon, between about three and 50 parts per million boron, and between about 15 and 95 parts per million nitrogen in the ratio to boron of one to 15 parts per part of boron, (b) electrolyzing a solid MgO-buffered aqueous electrolytic formate-metaborate solution consisting essentially of magnesium formate and magnesium metaborate and containing magnesia with said silicon-iron sheet being arranged as the cathode in said solution and said solution being at a temperature of at least about 65° C. and thereby covering the sheet with a boron-containing adherent electrically insulating but relatively thin coating of $Mg(OH)_2$ to form a primary coated sheet, (c) electrolyzing a solid MgO-buffered electrolytic formate solution consisting essentially of magnesium formate with said primary coated sheet arranged as the cathode in said magnesium formate solution and thereby covering the boron-containing $Mg(OH)_2$ coating with a substantially thicker electrically insulating secondary coating of $Mg(OH)_2$ to form a double-coated sheet, and (d) thereafter subjecting said double-coated sheet to a final heat treatment to develop (110) secondary recrystallization texture in the silicon-iron sheet.

2. The method of claim 1 in which said formate-metaborate electrolytic solution in codeposition step (b) consists of an aqueous magnesium formate-borate solution containing solid magnesium hydroxide.

3. The method of claim 2 in which said formate-metaborate electrolytic solution is of pH from 8.0 to 9.0 and includes magnesium formate in a concentration of about 0.2 molar.

4. The method of claim 1 in which said formate-metaborate electrolytic solution is maintained at a temperature between about 90° and 95° C. throughout the period of said codeposition step (b).

5. The method of claim 1 in which the electrically insulating boron-containing $Mg(OH)_2$ coating is about 0.02 to 0.07 mil thick and the $Mg(OH)_2$ secondary electrically insulating coating is about 0.10 to 0.18 mil thick.

6. The method of claim 5 in which the total thickness of said electrically insulating coatings is between about 0.10 and 0.40 mil thick.

7. The method of claim 5 in which the total thickness of said electrically insulating coatings is about 0.20 mil.

8. The double-coated, primary-recrystallized silicon-iron sheet of the process of claim 1.

* * * * *